US011657952B2

(12) United States Patent
Araki et al.

(10) Patent No.: US 11,657,952 B2
(45) Date of Patent: May 23, 2023

(54) COIL COMPONENT

(71) Applicant: Murata Manufacturing Co., Ltd., Kyoto-fu (JP)

(72) Inventors: Kenichi Araki, Nagaokakyo (JP); Keiichi Ishida, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 258 days.

(21) Appl. No.: 17/031,734

(22) Filed: Sep. 24, 2020

(65) Prior Publication Data

US 2021/0098183 A1 Apr. 1, 2021

(30) Foreign Application Priority Data

Sep. 30, 2019 (JP) ..... JP2019-179011

(51) Int. Cl.

| | |
|---|---|
| ***H01F 27/29*** | (2006.01) |
| ***H01F 27/28*** | (2006.01) |
| ***H01F 27/255*** | (2006.01) |
| ***H01F 41/063*** | (2016.01) |
| ***H01F 41/12*** | (2006.01) |
| ***H01F 41/02*** | (2006.01) |
| ***H01F 27/32*** | (2006.01) |

(52) U.S. Cl.

CPC ..... *H01F 27/2823* (2013.01); *H01F 27/255* (2013.01); *H01F 27/29* (2013.01); *H01F 27/327* (2013.01); *H01F 41/0246* (2013.01); *H01F 41/063* (2016.01); *H01F 41/127* (2013.01)

(58) Field of Classification Search

CPC ..... H01F 27/29

USPC ..... 336/192

See application file for complete search history.

(56) References Cited

U.S. PATENT DOCUMENTS

| | | | | |
|---|---|---|---|---|
| 2001/0017420 | A1* | 8/2001 | Iwao | H01F 17/0013 257/693 |
| 2013/0293334 | A1* | 11/2013 | Shin | H01F 41/046 336/192 |
| 2016/0293319 | A1* | 10/2016 | Hong | H01F 17/04 |
| 2017/0140866 | A1* | 5/2017 | Hong | H01F 27/255 |
| 2018/0130600 | A1* | 5/2018 | Xia | C03C 14/008 |
| 2018/0144859 | A1* | 5/2018 | Araki | H01F 27/2852 |
| 2018/0182537 | A1* | 6/2018 | Shimizu | H01F 27/29 |

(Continued)

FOREIGN PATENT DOCUMENTS

| | | |
|---|---|---|
| JP | S59-42009 U | 3/1984 |
| JP | H02-155205 A | 6/1990 |

(Continued)

*Primary Examiner* — Ronald Hinson

(74) *Attorney, Agent, or Firm* — Studebaker & Brackett PC

(57) ABSTRACT

A coil component is capable of suppressing occurrence of peeling at an interface between a coil conductor and resin in a magnetic portion due to heating during mounting. The coil component includes an element body that includes a coil conductor formed by winding a conductive wire coated with an insulating film, and a magnetic portion that contains metal magnetic particles and resin, and external electrodes that are electrically connected to exposed surfaces of extended portions of the coil conductor exposed on a surface of the element body, and are arranged on the surface of the element body. The metal magnetic particles are arranged in recesses formed in a surface of the conductive wire in the extended portions of the coil conductor.

20 Claims, 12 Drawing Sheets

(56) References Cited

U.S. PATENT DOCUMENTS

| | | | | |
|---|---|---|---|---|
| 2018/0254138 | A1* | 9/2018 | Koo | H01F 27/29 |
| 2020/0075219 | A1* | 3/2020 | Matsumoto | H01F 27/2852 |
| 2021/0202154 | A1* | 7/2021 | Wakabayashi | H01F 27/32 |
| 2022/0208445 | A1* | 6/2022 | Yoshida | H01F 41/0246 |

FOREIGN PATENT DOCUMENTS

| | | | |
|---|---|---|---|
| JP | 2018-085459 | A | 5/2018 |
| JP | 2019-080073 | A | 5/2019 |
| JP | 2019-106482 | A | 6/2019 |

* cited by examiner

COIL COMPONENT

CROSS-REFERENCE TO RELATED APPLICATION

This application claims benefit of priority to Japanese Patent Application No. 2019-179011, filed Sep. 30, 2019, the entire content of which is incorporated herein by reference.

BACKGROUND

Technical Field

The present disclosure relates to a coil component.

Background Art

As a coil component of the related art, a coil component that includes metal magnetic particles and a magnetic portion made of resin in which a coil conductor is buried in the magnetic portion, and an end of the coil conductor is extended to a surface of the magnetic portion is disclosed, for example, in Japanese Patent Application Laid-Open No. 2019-080073.

SUMMARY

In the coil component disclosed in Japanese Patent Application Laid-Open No. 2019-080073, an insulating film is coated on a surface of the coil conductor. When the coil component including such a coil conductor is mounted on a mounting substrate by using solder by reflow, the coil component may expand due to heating during mounting. When the coil component expands, deviation occurs at an interface between the coil conductor and the resin in the magnetic portion due to a difference in thermal expansion coefficient between the coil conductor and the resin in the magnetic portion (usually the resin has a larger thermal expansion coefficient), and thus, there is a concern that peeling at the interface occurs.

Thus, the present disclosure provides a coil component capable of suppressing occurrence of peeling at an interface between a coil conductor and resin in a magnetic portion due to heating during mounting.

A coil component according to the present disclosure includes an element body that includes a coil conductor formed by winding a conductive wire coated with an insulating film, and a magnetic portion that contains metal magnetic particles and resin, and external electrodes that are electrically connected to exposed surfaces of extended portions of the coil conductor exposed on a surface of the element body, and are arranged on the surface of the element body. The metal magnetic particles are arranged in recesses formed in a surface of the conductive wire in the extended portions of the coil conductor.

In the coil component according to the present disclosure, since the recesses are formed on the surfaces of the extended portions of the coil conductor and the metal magnetic particles contained in the magnetic portion are arranged in the recesses, an anchor effect occurs on the coil conductor by the metal magnetic particles, and thus, the bonding strength between the magnetic portion and the coil conductor can be improved.

According to the present disclosure, it is possible to provide the coil component capable of suppressing the occurrence of peeling at the interface between the coil conductor and the resin in the magnetic portion due to heating during mounting.

The above-mentioned objects, other objects, features, and advantages of the present disclosure will become more apparent from the following description of the embodiments for carrying out the disclosure with reference to the drawings.

DETAILED DESCRIPTION

1. Coil Component

Hereinafter, a coil component of the present disclosure will be described in detail with reference to the drawings.

Figure 1:
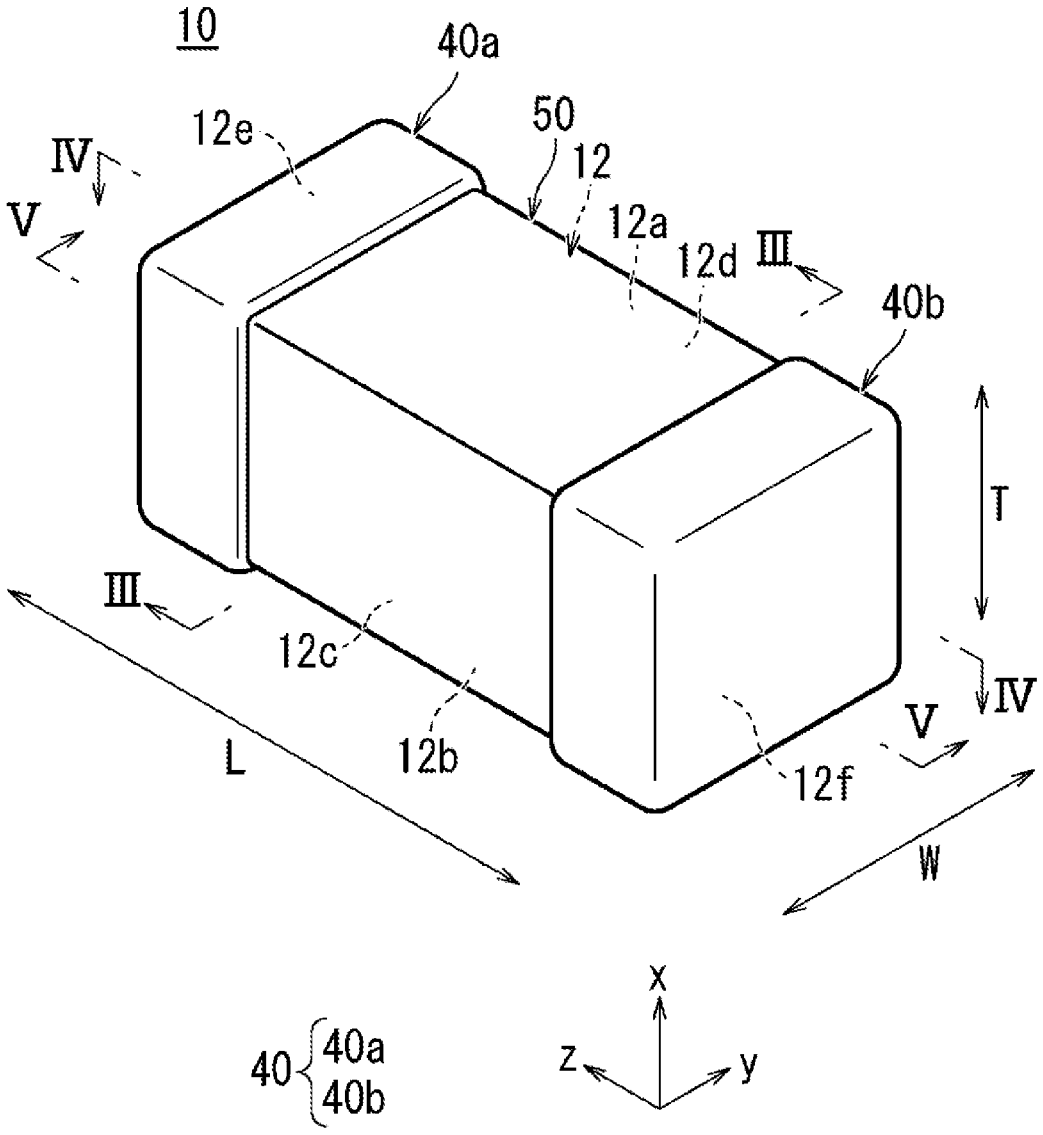
FIG. 1 is an external perspective view schematically illustrating an embodiment of a coil component of the present disclosure.
Figure 2:
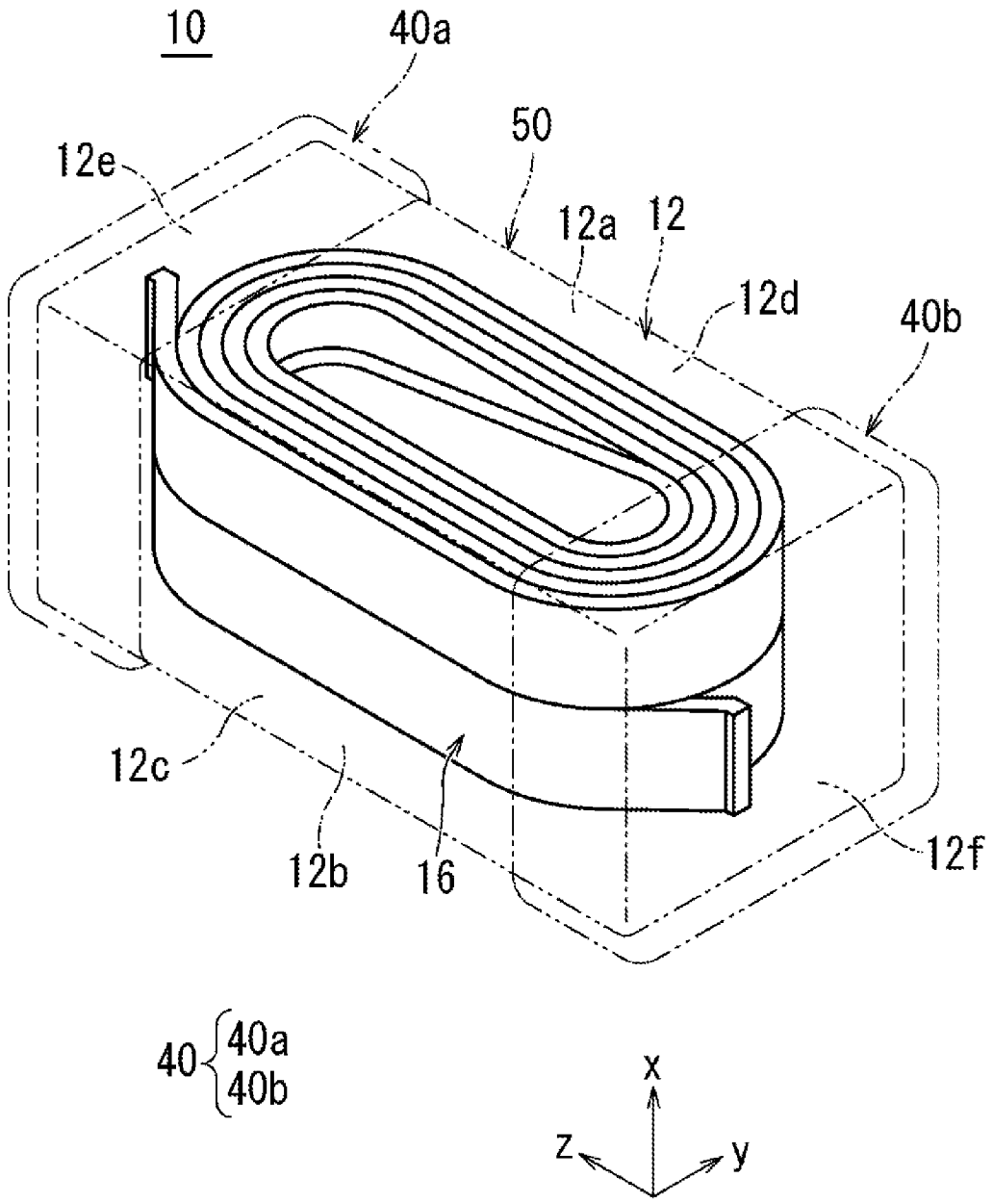
FIG. 2 is a transparent perspective view of a magnetic portion in which a coil conductor is buried in the coil component illustrated in FIG. 1.
Figure 3:
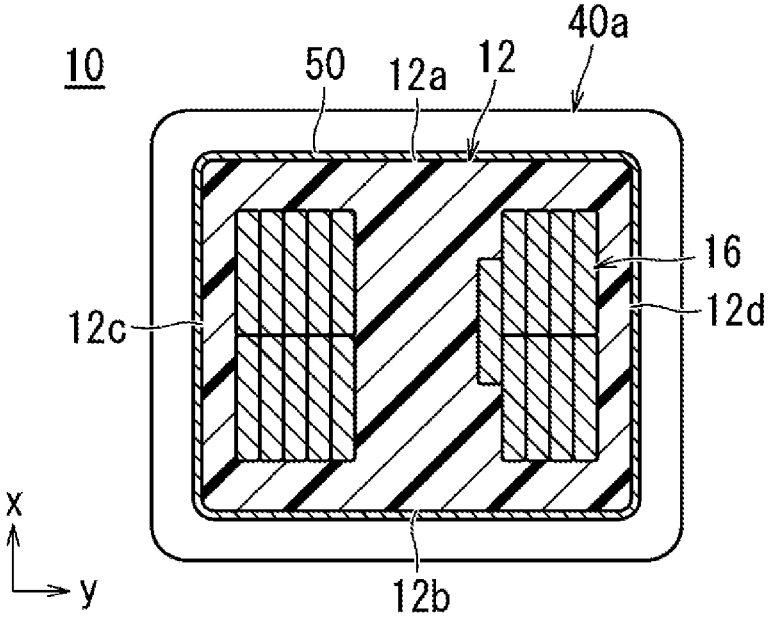
FIG. 3 is a sectional view taken along a line III-III of FIG. 1 illustrating the coil component according to the present disclosure.
Figure 4:
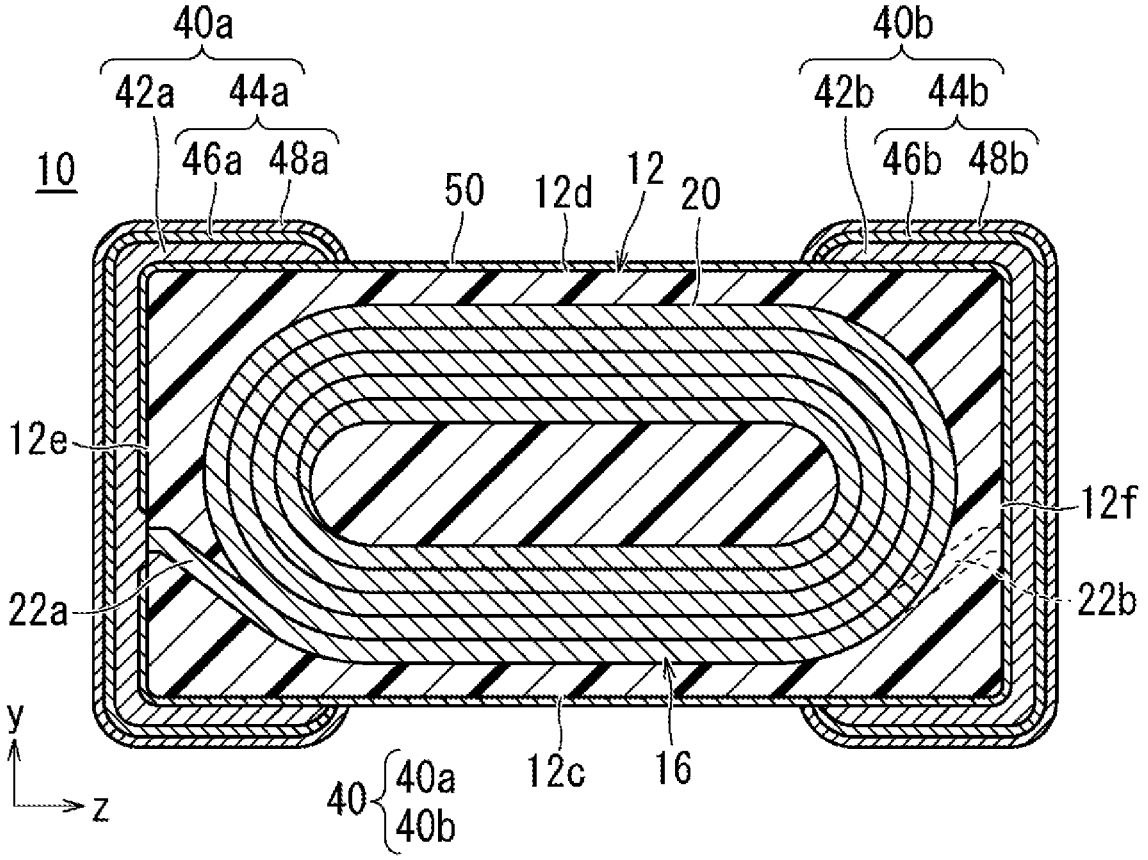
FIG. 4 is a sectional view taken along the line IV-IV in FIG. 1 illustrating the coil component according to the present disclosure.
Figure 5:
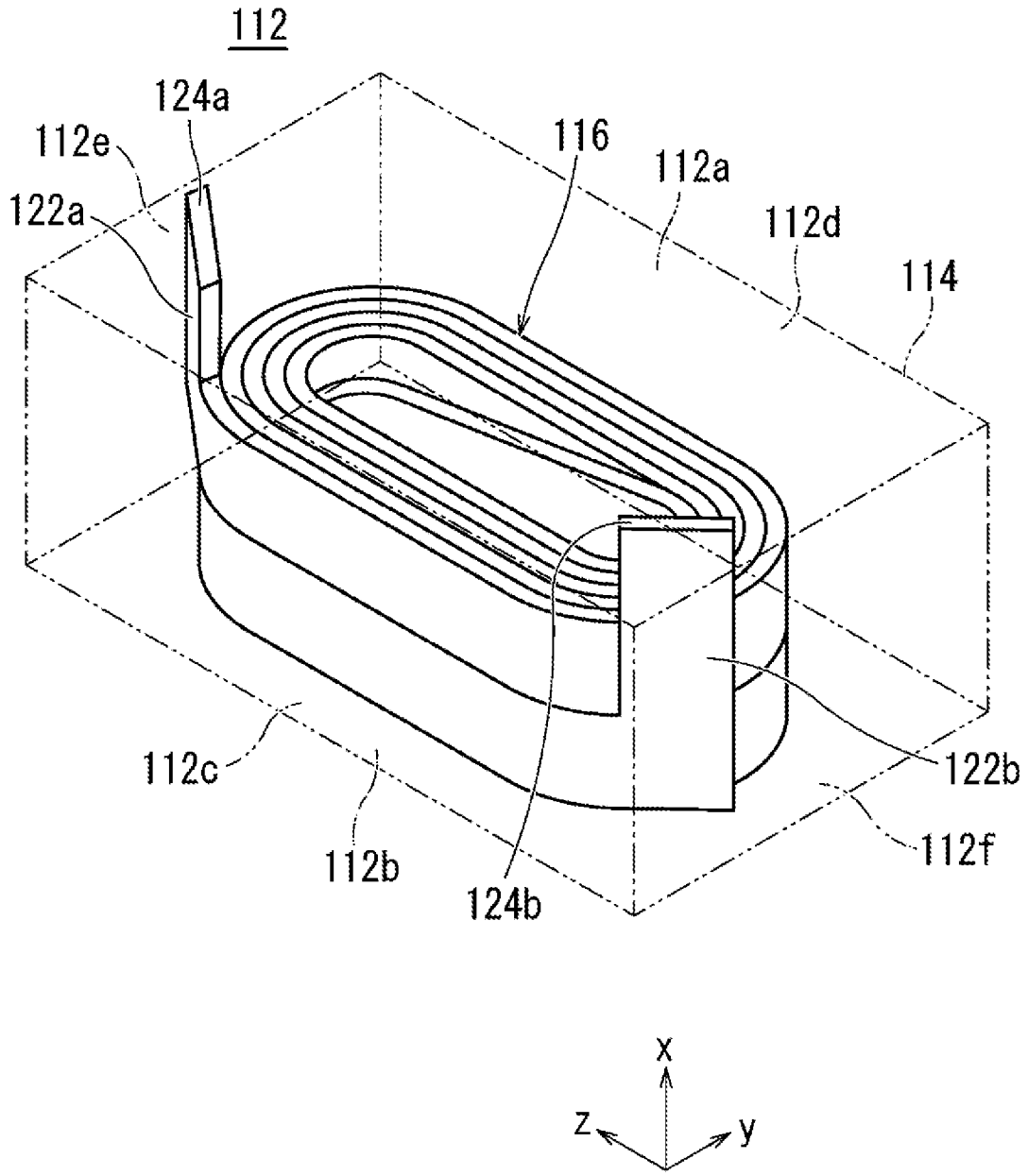
FIG. 5 is a transparent perspective view illustrating a first modification example of an element body of a coil component according to an embodiment of the present disclosure.
Figure 6A:
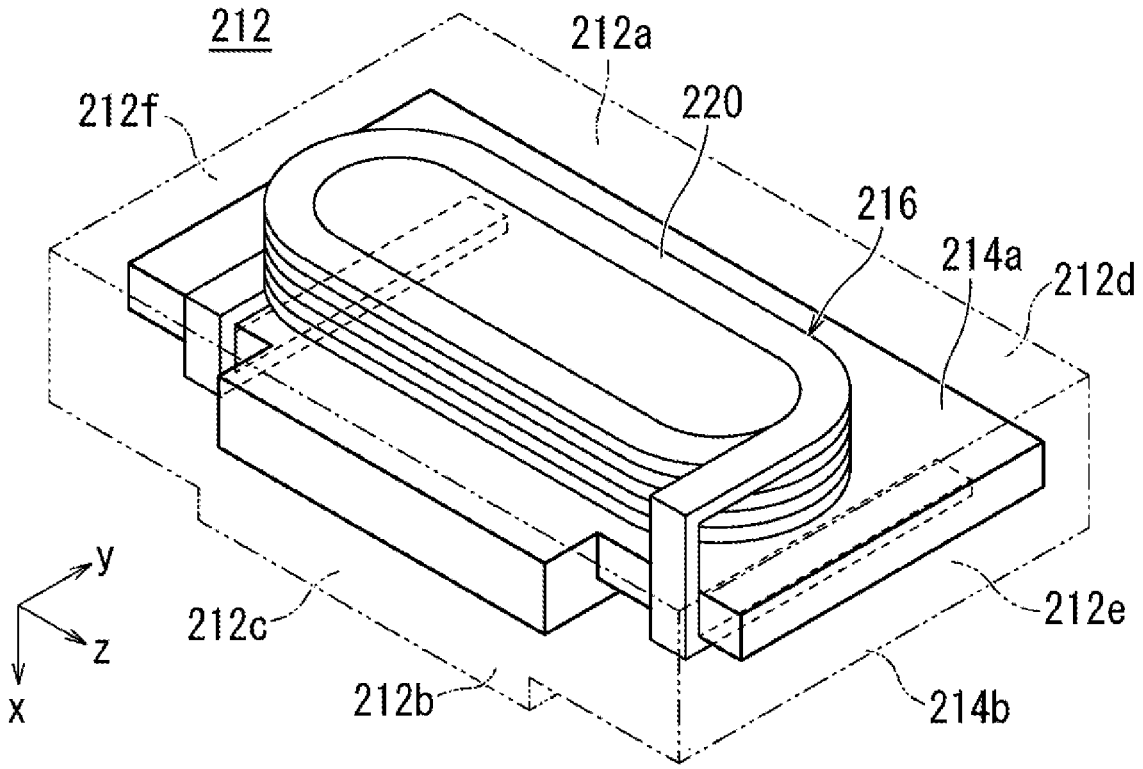
FIG. 6A is a transparent perspective view illustrating a second modification example of the element body of the coil component according to the embodiment of the present disclosure.
Figure 6B:
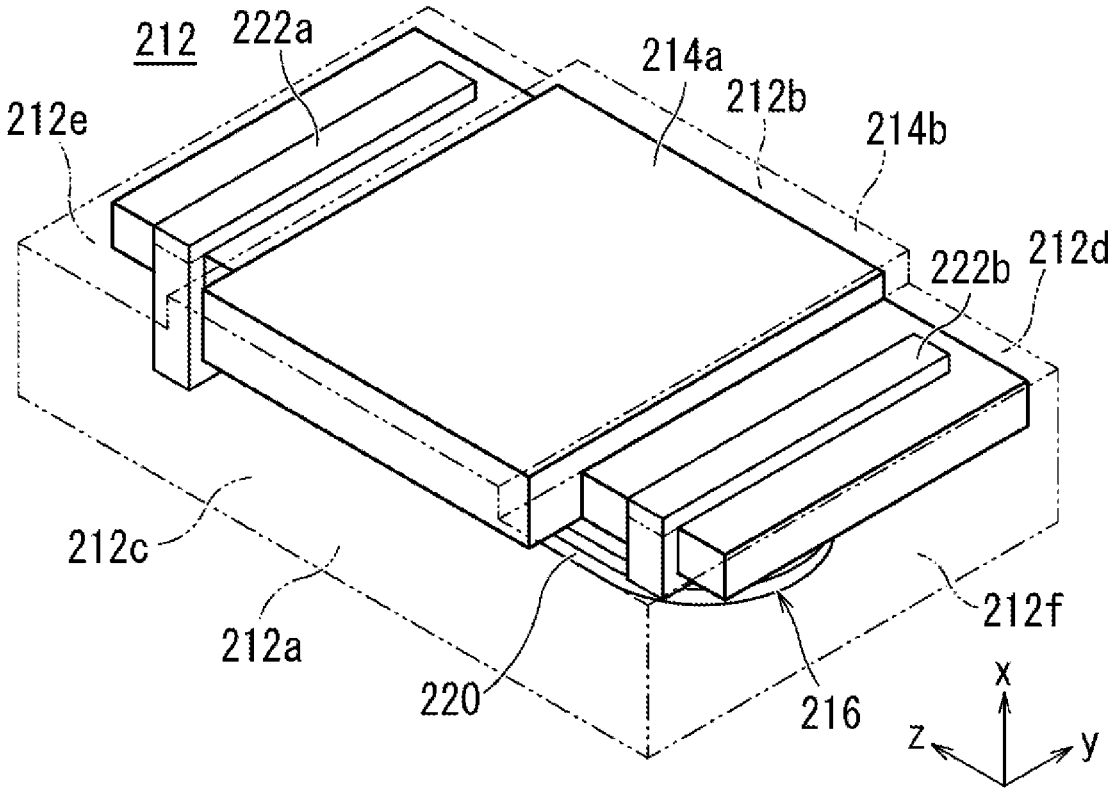
FIG. 6B is a transparent perspective view seen in a direction different from FIG. 6A.
Figure 7A:
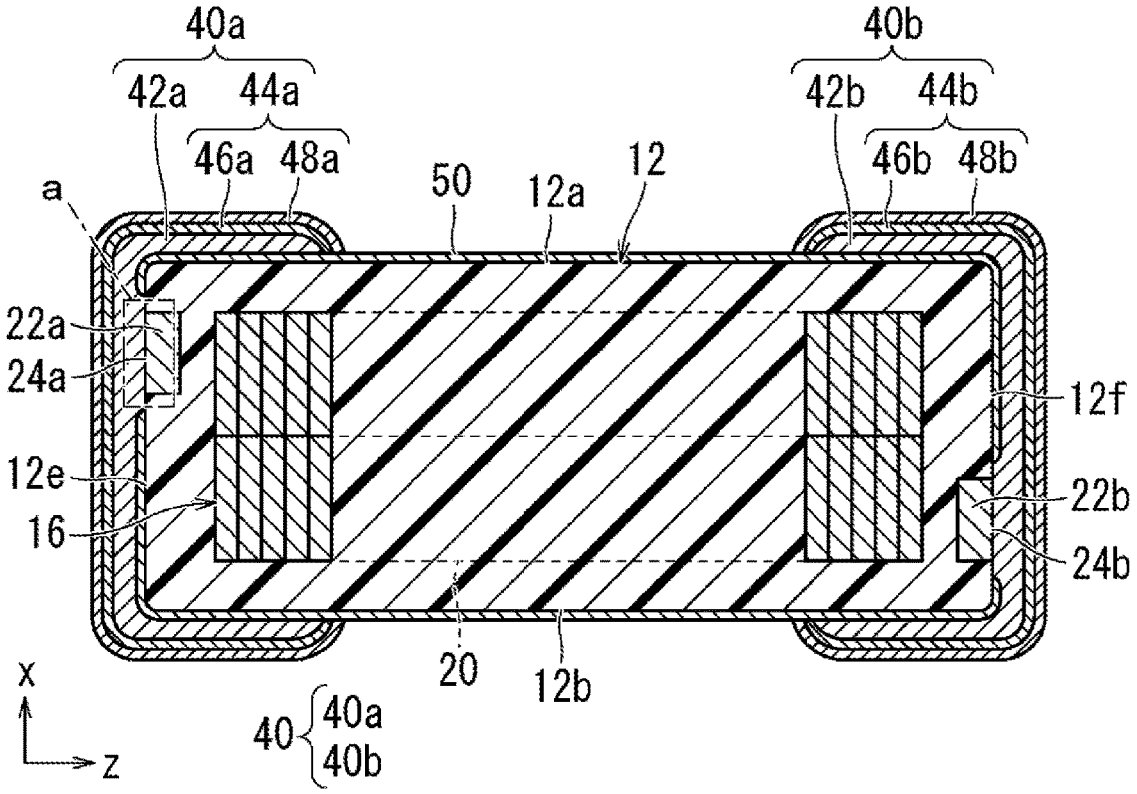
FIG. 7A is a sectional view taken along a line V-V of FIG. 1 illustrating the coil component according to the present disclosure.
Figure 7B:
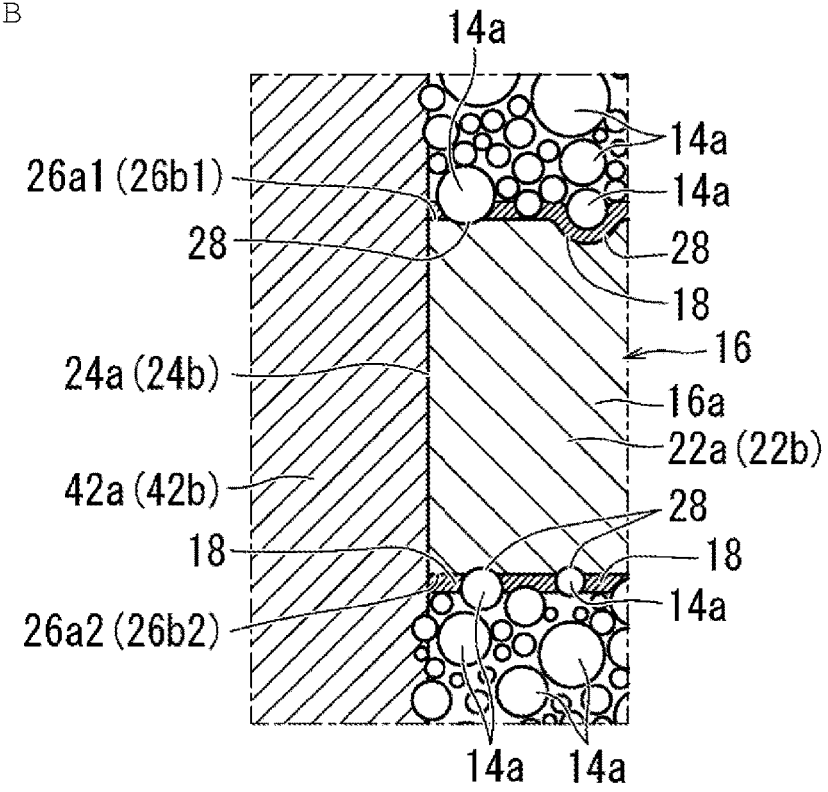
FIG. 7B is an enlarged sectional view of a portion a in FIG. 7A.

FIG. 1 is an external perspective view schematically illustrating an embodiment of a coil component of the present disclosure. FIG. 2 is a transparent perspective view of a magnetic portion in which a coil conductor in the coil component illustrated in FIG. 1 is buried. FIG. 3 is a sectional view taken along a line III-III of FIG. 1 illustrating the coil component according to the present disclosure. FIG. 4 is a sectional view taken along a line IV-IV of FIG. 1 illustrating the coil component according to the present disclosure. FIG. 5 is a transparent perspective view illustrating a first modification example of an element body of the coil component according to the embodiment of the present disclosure. FIG. 6A is a transparent perspective view illustrating a second modification example of the element body of the coil component according to the embodiment of the present disclosure, and FIG. 6B is a transparent perspective view seen in a direction different from FIG. 6A. FIG. 7A is a sectional view taken along a line V-V of FIG. 1 illustrating the coil component according to the present disclosure, and FIG. 7B is an enlarged sectional view of a portion a in FIG. 7A.

A coil component 10 includes a rectangular parallelepiped element body 12 and external electrodes 40.

(A) Element Body

The element body 12 includes a magnetic portion 14 and a coil conductor 16 buried in the magnetic portion 14. The element body 12 includes a first main surface 12*a* and a second main surface 12*b* facing in a pressing direction x, and a first side surface 12*c* and a second side surface 12*d* facing in a width direction y orthogonal to the pressing direction x, and a first end surface 12*e* and a second end surface 12*f* facing in a length direction z orthogonal to the pressing direction x and the width direction y. A dimension of the element body 12 is not particularly limited.

(B) Magnetic Portion

The magnetic portion 14 includes metal magnetic particles and a resin material.

The resin material is not particularly limited, but, for example, thermosetting resin may be used, or organic materials such as epoxy resin, phenol resin, polyester resin, polyimide resin, and polyolefin resin may be used. The resin material may be only one kind or two or more kinds.

The metal magnetic particles preferably include first metal magnetic particles and second metal magnetic particles.

The first metal magnetic particles have an average particle diameter of 10 μm or more. The first magnetic particles have an average particle diameter of preferably 200 μm or less, more preferably 100 μm or less, and even more preferably 80 μm or less. The average particle diameter of the first metal magnetic particles is set to 10 μm or more, and thus, magnetic characteristics of the magnetic portion are improved.

The second metal magnetic particles have an average particle diameter smaller than the average particle diameter of the first metal magnetic particles. The second metal magnetic particles have an average particle diameter of 5 μm or less. As described above, the average particle diameter of the second metal magnetic particles is set to be smaller than the average particle diameter of the first metal magnetic particles, and thus, filling properties of the metal magnetic particles in the magnetic portion 14 are further improved. Accordingly, the magnetic characteristics of the coil component 10 can be improved.

Here, the average particle diameter means an average particle diameter D50 (particle diameter corresponding to a cumulative percentage of 50% on a volume basis). The average particle diameter D50 can be measured by, for example, a dynamic light scattering particle size analyzer (UPA manufactured by Nikkiso Co., Ltd.).

The first metal magnetic particles and the second metal magnetic particles are not particularly limited, but, for example, iron, cobalt, nickel, gadolinium, or an alloy containing one or more of these metal materials. Preferably, the first metal magnetic particles and the second metal magnetic particles are iron or an iron alloy. The iron alloy is not particularly limited, but, for example, Fe—Si, Fe—Si—Cr, Fe—Ni, and Fe—Si—Al may be used. The first metal magnetic particles and the second metal magnetic particles may be only one kind, or may be two or more kinds.

Surfaces of the first metal magnetic particles and the second metal magnetic particles may be covered with an insulating film. The surfaces of the metal magnetic particles are covered with the insulating film, and thus, an internal specific resistance of the magnetic portion 14 can be increased. Since insulation properties are secured by covering the surfaces of the metal magnetic particles with the insulating film, a short-circuit failure with the coil conductor 16 can be suppressed.

Silicon oxides, phosphoric acid based glass, and bismuth based glass may be used as the material of the insulating film. In particular, an insulating film made of zinc phosphate glass which is obtained by mechanochemically treating the metal magnetic particles is preferably used.

A thickness of the insulating film is not particularly limited, but may be preferably 5 nm or more and 500 nm or less (i.e., from 5 nm to 500 nm), more preferably 5 nm or more and 100 nm or less (i.e., from 5 nm to 100 nm), and even more preferably 10 nm or more and 100 nm or less (i.e., from 10 nm to 100 nm). The thickness of the insulating film is further increased, and thus, the specific resistance of the magnetic portion 14 can be further increased. The thickness of the insulating film is further decreased, and thus, the amount of metal magnetic particles in the magnetic portion 14 can be further increased. Accordingly, the magnetic characteristics of the magnetic portion 14 are improved.

A content of the first metal magnetic particles and the second metal magnetic particles in the magnetic portion 14 is preferably 50% by volume or more, more preferably 60% by volume or more, and even more preferably 70% by volume or more with respect to the entire magnetic portion. The content of the first metal magnetic particles and the second metal magnetic particles is set in such ranges, and thus, the magnetic characteristics of the coil component of the present disclosure are improved. The content of the first metal magnetic particles and the second metal magnetic particles in the entire magnetic portion 14 is preferably 99% by volume or less, more preferably 95% by volume or less, and even more preferably 90% by volume or less. The content of the first metal magnetic particles and the second metal magnetic particles is set in such ranges, and thus, the specific resistance of the magnetic portion 14 can be further increased.

A region of the surface of the magnetic portion 14 that is adjacent to the coil conductor 16 may be removed. The magnetic portion 14 of the region adjacent to the coil conductor 16 is removed, and thus, a gap between the magnetic portion 14 and the coil conductor 16 is increased. Accordingly, a medium easily enters when barrel plating treatment is performed, and a plating film is formed on a wider area of the coil conductor 16. Accordingly, the improvement of bonding strength and the reduction of a DC resistance are expected.

(C) Coil Conductor

The coil conductor 16 includes a winding portion 20 formed by winding a conductive wire containing a conductive material in a coil shape, a first extended portion 22*a* extended to one side of the winding portion 20, and a second extended portion 22*b* extended to the other side of the winding portion 20.

The winding portion 20 is formed by winding the conductive wire in two stages. The coil conductor 16 is formed by winding a rectangular conductive wire in an α-wound shape. The rectangular conductive wire has a dimension of 15 μm or more and 200 μm or less (i.e., from 15 μm to 200 μm) in the width direction y, and has a dimension of 50 μm or more and 500 μm or less (i.e., from 50 μm to 500 μm) in the pressing direction x.

The first extended portion 22*a* is exposed on the first end surface 12*e* of the element body 12, and a first exposed portion 24*a* is arranged. The second extended portion 22*b* is exposed on the second end surface 12*f* of the element body 12, and a second exposed portion 24*b* is arranged.

Here, the first modification example of the element body 12 of the coil component 10 according to the embodiment of the present disclosure will be illustrated.

FIG. 5 is a transparent perspective view illustrating the first modification example of the element body of the coil component according to the embodiment of the present disclosure.

An element body 112 includes a magnetic portion 114 and a coil conductor 116 buried in the magnetic portion 114. The element body 112 includes a first main surface 112*a* and a second main surface 112*b* facing in a height direction x, a first side surface 112*c* and a second side surface 112*d* facing in a width direction y orthogonal to the height direction x, and a first end surface 112*e* and a second end surface 112*f* facing in a length direction z orthogonal to the height direction x and the width direction y.

The coil conductor 116 includes a winding portion 120 formed by winding a conductive wire containing a conductive material in a coil shape, a first extended portion 122*a* extended to one side of the winding portion 120, and a second extended portion 122*b* extended to the other side of the winding portion 120.

The first extended portion 122*a* is extended to and is exposed on the first main surface 112*a* of the element body 112, and a first exposed portion 124*a* is arranged. The second extended portion 122*b* is exposed on the first main surface 112*a* of the element body 112, and a second exposed portion 124*b* is arranged.

The second modification example of the element body 12 of the coil component 10 according to the embodiment of the present disclosure will be illustrated.

FIG. 6A is a transparent perspective view illustrating the second modification example of the element body of the coil component according to the embodiment of the present disclosure, and FIG. 6B is a transparent perspective view seen in a direction different from FIG. 6A.

As illustrated in FIGS. 6A and 6B, an element body 212 includes a magnetic portion 214 and a coil conductor 216 buried in the magnetic portion 214. The magnetic portion 214 includes a first magnetic portion 214*a* arranged inside the element body 212 and a second magnetic portion 214*b* that covers the first magnetic portion 214*a* and the coil conductor 216.

The element body 212 is formed in a substantially rectangular parallelepiped shape, and includes a first main surface 212*a* and a second main surface 212*b* facing in the height direction x, a first side surface 212*c* and a second side surface 212*d* facing in the width direction y orthogonal to the height direction x, and a first end surface 212*e* and a second end surface 212*f* facing in the length direction z orthogonal to the height direction x and the width direction y.

The coil conductor 216 is arranged on one surface side of the first magnetic portion 214*a*, and includes a winding portion 220 formed by winding a conductive wire containing a conductive material in a coil shape, a first extended portion 222*a* extended to one side of the winding portion 220, and a second extended portion 222*b* extended to the other side of the winding portion 220. The first extended portion 222*a* is extended to and is exposed on the second main surface 212*b* of the element body 212 on the first end surface 212*e* side, and the second extended portion 222*b* is extended to and is exposed on the second main surface 212*b* of the element body 212 on the second end surface 212*f* side.

As described above, the first extended portion 222*a* may be formed and arranged on the second main surface 212*b* of the element body 212, and the second extended portion 222*b* may be formed and arranged on the second main surface 212*b* of the element body 212.

The coil conductor 16 is formed by a conductive wire 16*a* such as a metal wire or a wire. A conductive material of the coil conductor 16 is not particularly limited, but, for example, Ag, Au, Cu, Pd, and Ni may be used. Preferably, the conductive material is copper. The conductive material may be only one kind or two or more kinds.

An insulating film 18 is formed on a surface of the conductive wire 16*a* forming the coil conductor 16 by being coated with an insulating material. The conductive wire 16*a* forming the coil conductor 16 is coated with the insulating material, and thus, it is possible to more reliably insulate the wound portions of the coil conductor 16 from each other and the coil conductor 16 and the magnetic portion 14 from each other.

The insulating film 18 is not formed on each of the first exposed portion 24*a* and the second exposed portion 24*b* of the conductive wire 16*a* forming the coil conductor 16. Accordingly, the external electrodes 40 are easily formed by plating treatment. A resistance value in electrical connection between the coil conductor 16 and the external electrodes 40 can be further decreased.

The insulating material of the insulating film 18 is not particularly limited, but, for example, polyurethane resin, polyester resin, epoxy resin, and polyamide-imide resin are used. Preferably, the polyamide-imide resin may be used as the insulating film 18.

A thickness of the insulating film 18 is preferably 2 μm or more and 10 μm or less (i.e., from 2 μm to 10 μm).

As illustrated in FIG. 7B, a plurality of recesses 28 is formed in a surface 26*a*1 and a surface 26*a*2 of the first extended portion 22*a* of the conductive wire 16*a* in the coil conductor 16 on the first main surface 12*a* side and on the second main surface 12*b* side, respectively. The metal magnetic particles 14*a* and the insulating film 18 are arranged in the recesses 28. Alternatively, only the metal magnetic particles 14*a* are arranged in the recesses 28. At this time, when the metal magnetic particles 14*a* are arranged in the recesses 28, the metal magnetic particles 14*a* may or may not penetrate the insulating film 18 formed on the surface 26*a*1 and the surface 26*a*2 of the first extended portion 22*a* on the first main surface 12*a* side and the second main surface 12*b* side, respectively.

Similarly, the plurality of recesses 28 is formed on a surface 26*b*1 and a surface 26*b*2 of the second extended portion 22*b* of the conductive wire 16*a* in the coil conductor 16 on the first main surface 12*a* side and the second main surface side, respectively. The metal magnetic particles 14*a* and the insulating film 18 are arranged in the recesses 28. Alternatively, only the metal magnetic particles 14*a* are arranged in the recesses 28. At this time, when the metal magnetic particles 14*a* are arranged in the recesses 28, the metal magnetic particles 14*a* may or may not penetrate the insulating film 18 formed on the surface 26*b*1 and the surface 26*b*2 of the second extended portion 22*b* on the first main surface 12*a* side and the second main surface 12*b* side, respectively.

It is preferable that the insulating film 18 be not arranged on the exposed portions (exposed surfaces) of the first exposed portion 24*a* and the second exposed portion 24*b* of the coil conductor 16 at both the end surfaces 12*e* and 12*f*, respectively, of the element body 12. Accordingly, since the coil conductor 16 and the external electrodes 40 can be directly electrically connected to each other, an electrical connection resistance between the coil conductor 16 and the external electrodes 40 can be reduced.

In the metal magnetic particles 14*a* in contact with the external electrodes 40, an average thickness of the insulating films that are in contact with the external electrodes 40 is preferably smaller than an average thickness of the insulating films that are not in contact with the external electrodes 40. Accordingly, when the external electrodes 40 are formed by plating, the metal magnetic particles 14*a* positioned on peripheries of the first extended portion 22*a* and the second extended portion 22*b* of the coil conductor 16 exposed on the first end surface 12*e* and the second end surface 12*f*, respectively, of the element body 12 can be concentratedly energized, and can be grown by plating.

A structure of the peripheries of the exposed surfaces of the extended portions of the coil conductor 16 exposed on the surface of the element body 12 may be a structure to be described below.

Figure 8:
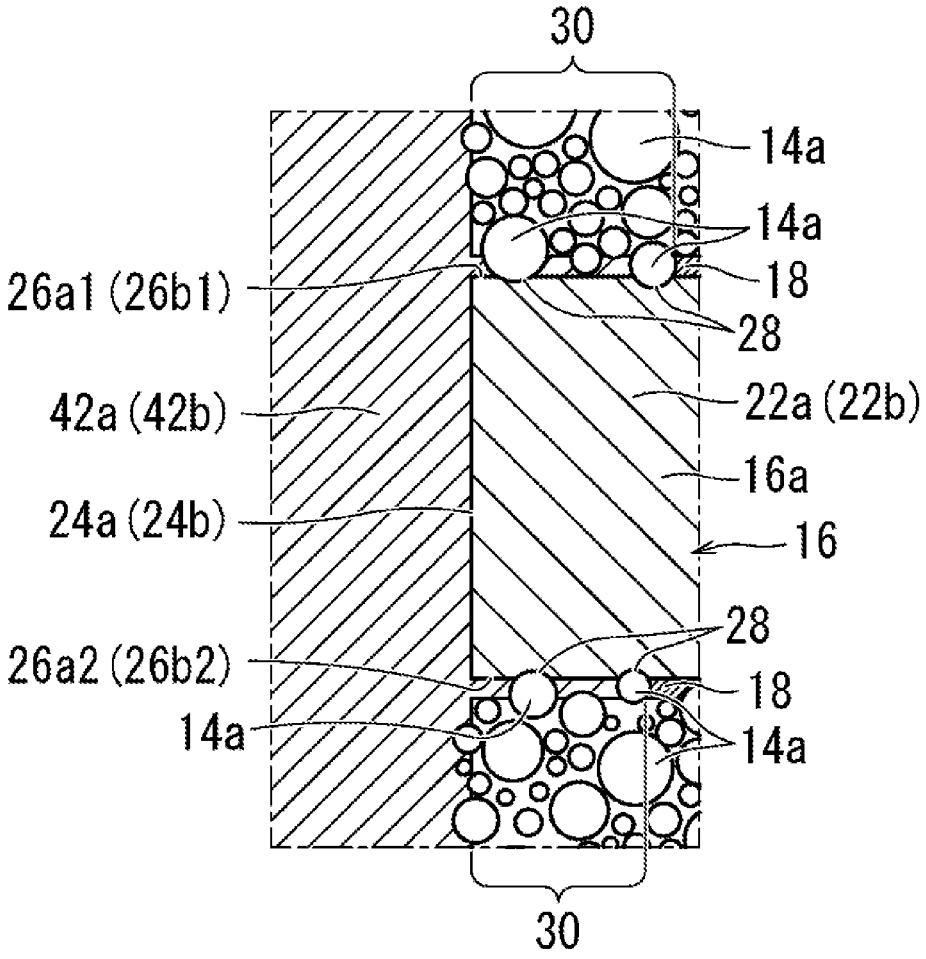
FIG. 8 is an enlarged sectional view illustrating a first modification example of a structure on peripheries of extended portions of the coil conductor.

FIG. 8 is an enlarged sectional view illustrating a first modification example of the structure of the peripheries of the extended portions of the coil conductor 16.

As illustrated in FIG. 8, insulating film removed portions 30 which do not include the insulating film 18 toward both the end surfaces 12*e* and 12*f* of the element body 12 are formed at the first extended portion 22*a* and the second extended portion 22*b*, respectively, of the coil conductor 16. The plurality of recesses 28 is formed on the surface 26*a*1 and the surface 26*a*2 of the first extended portion 22*a* of the coil conductor 16 on the first main surface 12*a* side and the second main surface 12*b* side, and the metal magnetic particles 14*a* are arranged in the recesses 28. Similarly, the plurality of recesses 28 is formed on the surface 26*b*1 and the surface 26*b*2 of the second extended portion 22*b* of the coil conductor 16 on the first main surface 12*a* side and the second main surface 12*b* side, respectively, and the metal magnetic particles 14*a* are arranged in the recesses 28. Accordingly, the metal magnetic particles 14*a* are directly arranged in the recesses 28 at the insulating film removed portions 30 without penetrating the insulating film 18.

As described above, when the recesses 28 are formed in the surface of the coil conductor 16 by the metal magnetic particles 14*a*, since the insulating film 18 acts as a cushion, the insulating film acts in a direction of inhibiting the formation of the recesses 28. However, the insulating film 18 is removed, and thus, the recesses 28 can be easily formed on the surface of the coil conductor 16.

It is preferable that a part of the external electrodes 40 be arranged at the insulating film removed portions 30. Accordingly, the bonding strength between the coil conductor 16 and the external electrodes 40 can be further improved.

Figure 9:
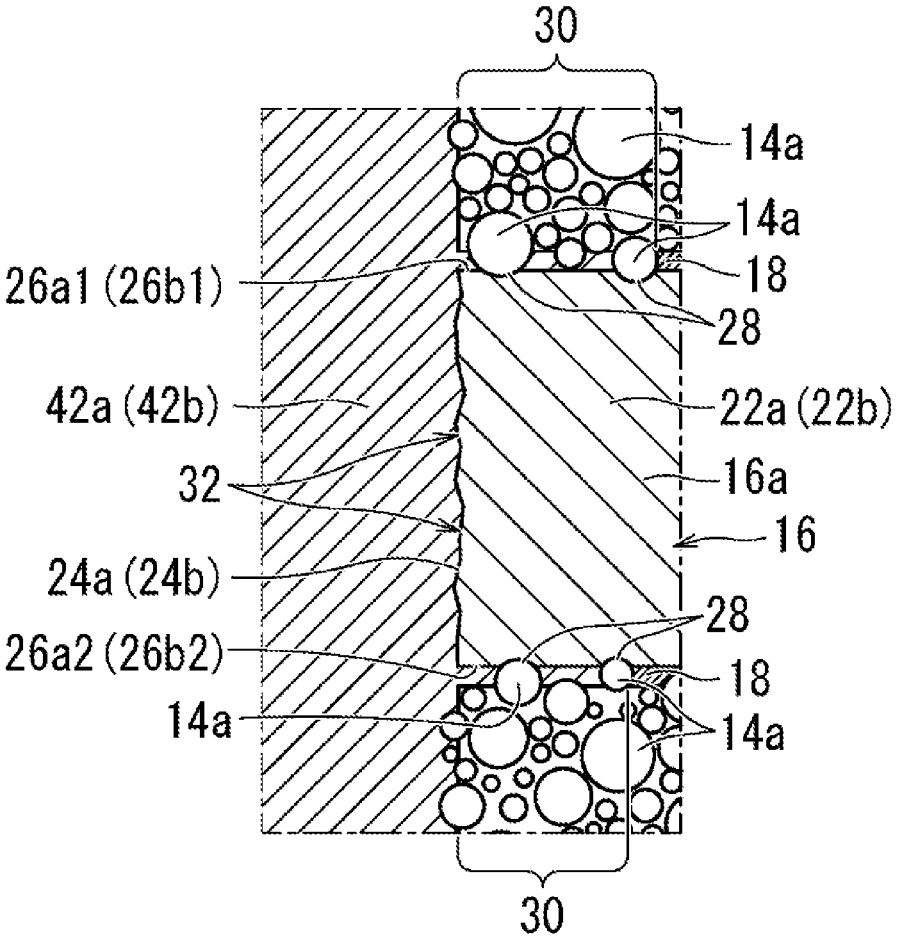
FIG. 9 is an enlarged sectional view illustrating a second modification example of the structure on the peripheries of extended portions of the coil conductor.

FIG. 9 is an enlarged sectional view illustrating a second modification example of the structure of the peripheries of the extended portions of the coil conductor 16.

Similarly to the first modification example of the structure of the peripheries of the extended portions of the coil conductor 16, in the second modification example of the peripheries of the extended portions of the coil conductor 16, the insulating film removed portions 30 which do not include the insulating film 18 toward both the end surfaces 12*e* and 12*f* of the element body 12 are formed at the first extended portion 22*a* and the second extended portion 22*b*, respectively, of the coil conductor 16 as illustrated in FIG. 9. Minute irregularities 32 are further formed on surfaces of the exposed portions of the first exposed portion 24*a* and the second exposed portion 24*b* of the coil conductor 16 on both the end surfaces 12*e* and 12*f*, respectively, of the element body 12. Accordingly, since a surface area of the coil conductor 16 and the external electrodes 40 in contact with each other can be increased, the bonding strength between the coil conductor 16 and the external electrode 40 can be further improved.

Figure 10:
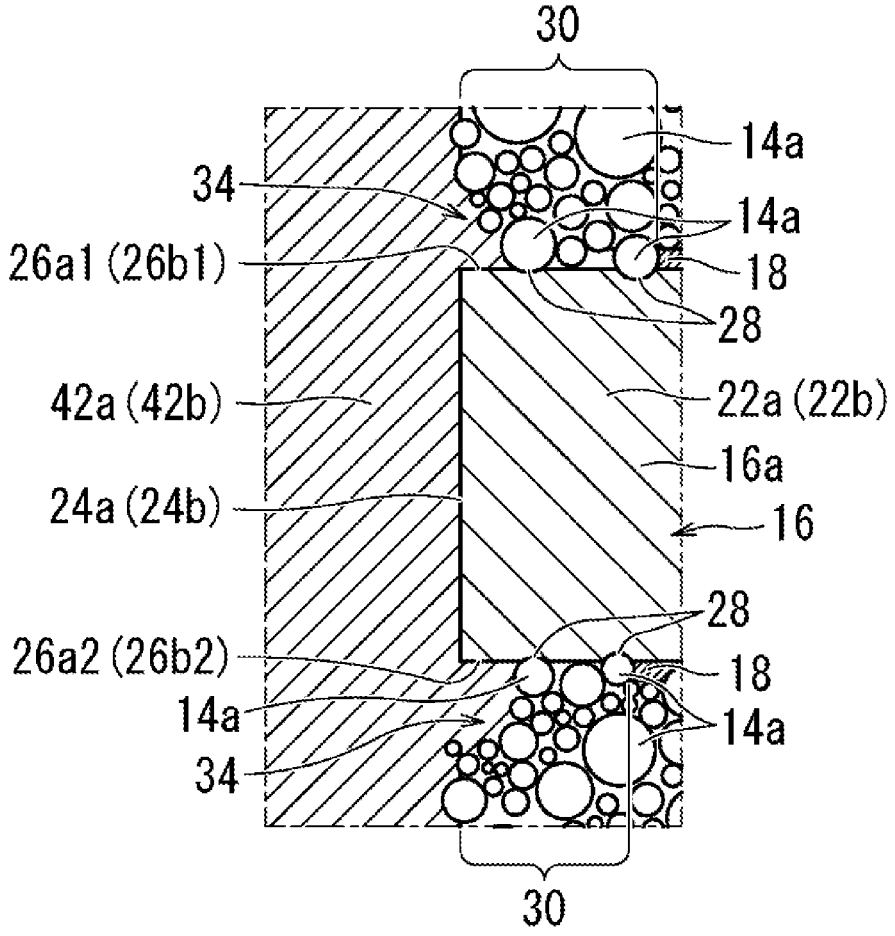
FIG. 10 is an enlarged sectional view illustrating a third modification example of the structure on the peripheries of the extended portions of the coil conductor.

FIG. 10 is an enlarged sectional view illustrating a third modification example of the structure of the peripheries of the extended portions of the coil conductor 16.

Similarly to the first modification example of the structure of the peripheries of the extended portions of the coil conductor 16, in the third modification of the peripheries of the extended portion of the coil conductor 16, the insulating film removed portions 30 which do not include the insulating film 18 toward both the end surfaces 12*e* and 12*f* of the element body 12 are formed at the first extended portion 22*a* and the second extended portion 22*b*, respectively, of the coil conductor 16 as illustrated in FIG. 10. Indented portions 34 are formed in the element body 12 on peripheries of the exposed portions of the first exposed portion 24*a* and the second exposed portion 24*b* of the coil conductor 16 on both the end surfaces 12*e* and 12*f*, respectively, of the element body 12. The indented portions 34 are formed such that an average distance between the coil conductor 16 and the magnetic portion 14 is increased in a direction in which the first extended portion 22*a* and the second extended portion 22*b* of the coil conductor 16 are extended to both the end surfaces 12*e* and 12*f*. Accordingly, since the external electrodes 40 can be arranged such that the indented portions 34 formed on the peripheries of the exposed portions of the first exposed portion 24*a* and the second exposed portion 24*b* of the coil conductor 16 on both the end surfaces 12*e* and 12*f*, respectively, of the element body 12 are filled, the bonding strength between the coil conductor 16 and the external electrodes 40 can be further improved.

Figure 11A:
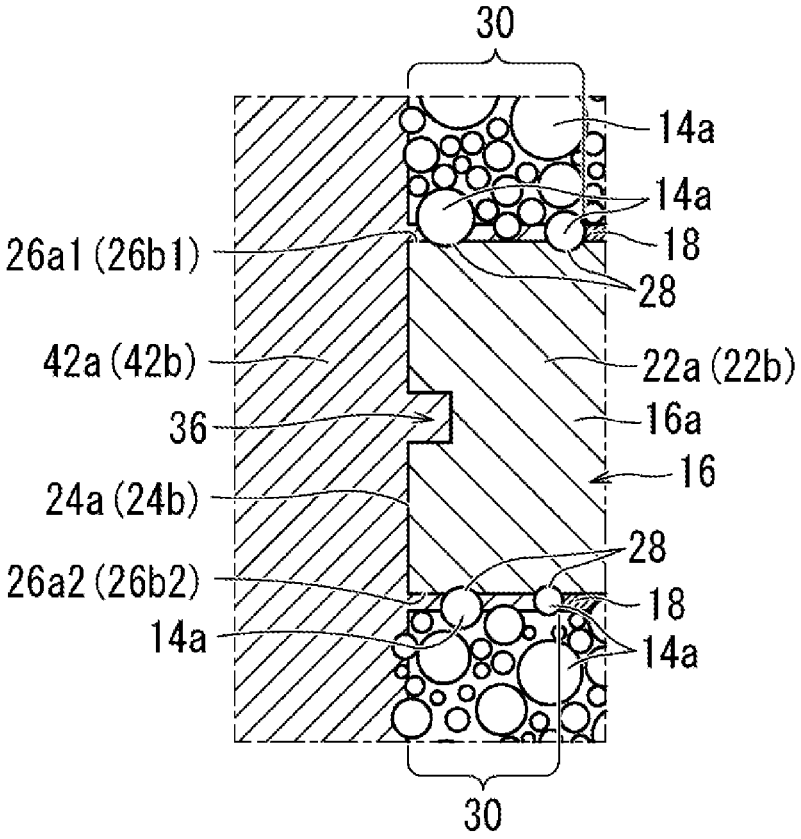
FIG. 11A is an enlarged sectional view illustrating a fourth modification example of the structure on the peripheries of the extended portions of the coil conductor.
Figure 11B:
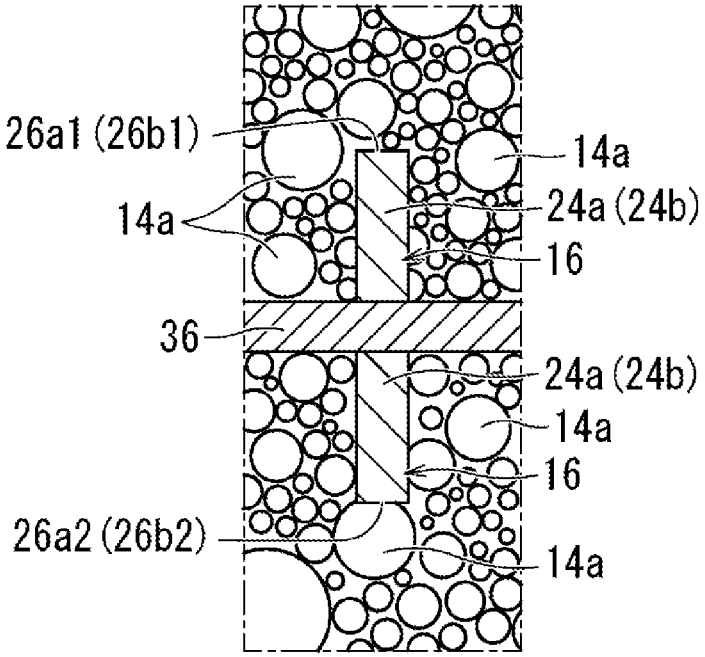
FIG. 11B is an enlarged view illustrating a fourth modification example of the structure on the peripheries of the extended portions of the coil conductor seen from an end surface side of the element body excluding external electrodes.

FIGS. 11A and 11B are enlarged sectional views illustrating a fourth modification example of the structure of the peripheries of the extended portions of the coil conductor 16.

Similarly to the first modification example of the structure of the peripheries of the extended portions of the coil conductor 16, in the fourth modification example of the peripheries of the extended portions of the coil conductor 16, the insulating film removed portions 30 which do not include the insulating film 18 toward both the end surfaces 12*e* and 12*f* of the element body 12 are formed at the first extended portion 22*a* and the second extended portion 22*b*, respectively, of the coil conductor 16 as illustrated in FIGS. 11A and 11B. Groove portions 36 are formed in both end surfaces 12*e* and 12*f* of the element body 12 and central portions of the surfaces (exposed surfaces) of the exposed portions of the first exposed portion 24*a* and the second exposed portion 24*b* of the coil conductor 16 on both the end surfaces 12*e* and 12*f*, respectively, of the element body 12 in the pressing direction x with a predetermined width in the width direction y. A depth of the groove portion 36 with respect to the element body 12 is preferably 5 μm or more and 100 μm or less (i.e., from 5 μm to 100 μm). Accordingly, since the external electrodes 40 can be arranged such that the groove portions 36 formed in both end surfaces 12*e* and 12*f* of the element body 12 and the surfaces (exposed surfaces) of the exposed portions of the first exposed portion 24*a* and the second exposed portion 24*b* of the coil conductor 16 on both the end surfaces 12*e* and 12*f*, respectively, of the element body 12 are filled, the bonding strength between the coil conductor 16 and the external electrode 40 can be further improved.

Although it has been described in FIGS. 7A to 11B that the structure of the peripheries of the exposed surfaces of the extended portions of the coil conductor 16 exposed on the surface of the element body 12 is the configuration in which the extended portions 22*a* and 22*b* of the coil conductor 16 are extended to and are exposed on both the end surfaces 12*e* and 12*f*, respectively, the present disclosure is not limited thereto. The structure of the peripheries of the exposed surfaces on which the extended portions 122*a* and 122*b* are exposed on the first main surface 112*a* side as illustrated in FIG. 5 or the structure of the peripheries of the exposed surfaces on which the extended portions 222*a* and 222*b* are exposed on the second main surface 212*b* side as illustrated in FIGS. 6A and 6B may be the same structure.

(D) External Electrode

The external electrodes 40 are arranged on the first end surface 12*e* side and the second end surface 12*f* side of the element body 12. The external electrode 40 includes a first external electrode 40*a* and a second external electrode 40*b*.

The first external electrode 40*a* is arranged on the surface of the first end surface 12*e* of the element body 12. The first external electrode 40*a* may be formed so as to extend from the first end surface 12*e* and cover a part of each of the first main surface 12*a*, the second main surface 12*b*, the first side surface 12*c*, and the second side surface 12*d*, or may be formed so as to extend from the first end surface 12*e* to the second main surface 12*b* and to cover a part of each of the first end surface 12*e* and the second main surface 12*b*. As illustrated in FIG. 5, when the first extended portion 122*a* of the coil conductor 116 is exposed on the first main surface 112*a*, the first external electrode 40*a* may be formed so as to cover a part of the first main surface 112*a*. As illustrated in FIGS. 6A and 6B, when the first extended portion 222*a* of the coil conductor 216 is formed and is exposed on the second main surface 212*b*, the first external electrode 40*a* may be formed so as to cover a part of the second main surface 212*b*. In this case, the first external electrode 40*a* is electrically connected to the first extended portion 22*a* of the coil conductor 16.

The second external electrode 40*b* is arranged on the surface of the second end surface 12*f* of the element body 12. The second external electrode 40*b* may be formed so as to extend from the second end surface 12*f* and cover a part of each of the first main surface 12*a*, the second main surface 12*b*, the first side surface 12*c*, and the second side surface 12*d*, or may be formed so as to extend from the second end surface 12*f* to the second main surface 12*b* and cover a part of each of the second end surface 12*f* and the second main surface 12*b*. As illustrated in FIG. 5, when the second extended portion 122*b* of the coil conductor 116 is exposed on the first main surface 112*a*, the second external electrode 40*b* may be formed so as to cover a part of the first main surface 112*a*. As illustrated in FIGS. 6A and 6B, when the second extended portion 222*b* of the coil conductor 216 is formed and is exposed on the second main surface 212*b*, the second external electrode 40*b* may be formed so as to cover a part of the second main surface 212*b*. In this case, the second external electrode 40*b* is electrically connected to the second extended portion 222*b* of the coil conductor 16.

A thickness of each of the first external electrode 40*a* and the second external electrode 40*b* is not particularly limited, but may be, for example, 1 μm or more and 50 μm or less (i.e., from 1 μm to 50 μm), and preferably 5 μm or more and 20 μm or less (i.e., from 5 μm to 20 μm).

The first external electrode 40*a* includes a first base electrode layer 42*a*, and a first plated layer 44*a* arranged on a surface of the first base electrode layer 42*a*. Similarly, the second external electrode 40*b* includes a second base electrode layer 42*b* and a second plated layer 44*b* arranged on a surface of the second base electrode layer 42*b*.

The first base electrode layer 42*a* is arranged on the surface of the first end surface 12*e* of the element body 12. The first base electrode layer 42*a* may be formed so as to extend from the first end surface 12*e* and cover a part of each of the first main surface 12*a*, the second main surface 12*b*, the first side surface 12*c*, and the second side surface 12*d*, and may be formed so as to extend from the first end surface 12*e* and cover a part of the second main surfaces 12*b*. As illustrated in FIG. 5, when the first extended portion 122*a* of the coil conductor 116 is exposed on the first main surface 112*a*, the first base electrode layer 42*a* may be formed so as to cover a part of the first main surface 112*a*. As illustrated in FIGS. 6A and 6B, when the first extended portion 222*a* of the coil conductor 216 is formed and is exposed on the second main surface 212*b*, the first base electrode layer 42*a* may be formed so as to cover a part of the second main surface 212*b*.

The second base electrode layer 42*b* is arranged on the surface of the second end surface 12*f* of the element body 12. The second base electrode layer 42*b* may be formed so as to extend from the second end surface 12*f* and cover a part of each of the first main surface 12*a*, the second main surface 12*b*, the first side surface 12*c*, and the second side surface 12*d*, or may be formed so as to extend from the second end surface 12*f* and cover apart of the second main surface 12*b*. As illustrated in FIG. 5, when the second extended portion 122*b* of the coil conductor 116 is exposed on the first main surface 112*a*, the second base electrode layer 42*b* may be formed so as to cover a part of the first main surface 112*a*. As illustrated in FIGS. 6A and 6B, when the second extended portion 222*b* of the coil conductor 216 is formed and is exposed on the second main surface 212*b*, the second base electrode layer 42*b* may be formed so as to cover a part of the second main surface 212*b*.

The first base electrode layer 42*a* and the second base electrode layer 42*b* are made of a conductive material, preferably one or more metal materials selected from Au, Ag, Pd, Ni, and Cu. The first base electrode layer 42*a* and the second base electrode layer 42*b* may be formed as plating electrodes, or may be formed by applying a conductor paste or sputtering.

An average thickness of the first base electrode layer 42*a* and the second base electrode layer 42*b* is, for example, 10 μm.

The first plated layer 44*a* is arranged so as to cover the first base electrode layer 42*a*. Specifically, the first plated layer 44*a* may be arranged so as to cover the first base electrode layer 42*a* arranged on the first end surface 12*e*, may be arranged so as to cover the surface of the first base electrode layer 42*a* arranged on the first main surface 12*a*, the second main surface 12*b*, the first side surface 12*c*, and the second side surface 12*d* so as to extend from the first end surface 12*e*, or may be arranged so as to cover the first base electrode layer 42*a* arranged so as to extend from the first end surface 12*e* and cover a part of the second main surface 12*b*. As illustrated in FIG. 5, when the first extended portion 122*a* of the coil conductor 116 is exposed on the first main surface 112*a*, the first plated layer 44*a* may be formed so as to cover the first base electrode layer 42*a* arranged on the first main surface 112*a*. As illustrated in FIGS. 6A and 6B, when the first extended portion 222*a* of the coil conductor 216 is formed and is directly extended to the second main surface 212*b*, the first plated layer 44*a* may be formed so as to cover the first base electrode layer 42*a* arranged on the second main surface 212*b*.

The second plated layer 44*b* is arranged so as to cover the second base electrode layer 42*b*. Specifically, the second plated layer 44*b* may be arranged so as to cover the second base electrode layer 42*b* arranged on the second end surface 12*f*, may be arranged so as to cover the surface of the second base electrode layer 42*b* arranged on the first main surface 12*a*, the second main surface 12*b*, the first side surface 12*c*, and the second side surface 12*d* so as to extend from the second end surface 12*f*, or may be arranged so as to cover the second base electrode layer 42*b* arranged so as to extend from the second end surface 12*f* and cover a part of the second main surface 12*b*. As illustrated in FIG. 5, when the second extended portion 122*b* of the coil conductor 116 is exposed on the first main surface 112*a*, the second plated layer 44*b* may be formed so as to cover the second base electrode layer 42*b* arranged on the first main surface 112*a*. As illustrated in FIGS. 6A and 6B, when the second extended portion 222*b* of the coil conductor 216 is formed and is directly extended to the second main surface 212*b*, the second plated layer 44*b* may be formed so as to cover the second base electrode layer 42*b* arranged on the second main surface 212*b*.

Metal materials of the first plated layer 44*a* and the second plated layer 44*b* include, for example, at least one selected from Cu, Ni, Ag, Sn, Pd, an Ag—Pd alloy, or Au.

The first plated layer 44*a* and the second plated layer 44*b* may be formed in multiple layers.

The first plated layer 44*a* has a two-layer structure of a first Ni plated layer 46*a* and a first Sn plated layer 48*a* on a surface of the first Ni plated layer 46*a*. The second plated layer 44*b* has a two-layer structure of a second Ni plated layer 46*b* and a second Sn plated layer 48*b* on a surface of the second Ni plated layer 46*b*.

An average thickness of the first Ni plated layer 46*a* and the second Ni plated layer 46*b* is, for example, 5 μm.

An average thickness of the first Sn plated layer 48*a* and the second Sn plated layer 48*b* is, for example, 10 μm.

The first external electrode 40*a* and the second external electrode 40*b* may have the following configurations.

For example, the first base electrode layer 42*a* and the second base electrode layer 42*b* may be resin electrodes containing Ag, or may be formed by an Ag sputtered layer by sputtering, a Cu sputtered layer, or a Ti sputtered layer. When the first base electrode layer 42*a* and the second base electrode layer 42*b* are Ag-containing resin electrodes, glass frit may be contained. When the first base electrode layer 42*a* and the second base electrode layer 42*b* are formed by sputtering, a Cu sputtered layer may be formed on a Ti sputtered layer.

The outermost layers of the first plated layer 44*a* and the second plated layer 44*b* may be formed of only the Sn plated layers 48*a* and 48*b*, respectively.

The Ag plated layer or the Ni plated layer may be formed on the element body 12 without forming the first base electrode layer 42*a* and the second base electrode layer 42*b*.

(E) Protective Layer

In the present embodiment, a protective layer 50 is formed on the surface of the element body 12 excluding the first exposed portion 24*a* exposed on the first end surface 12*e* of the element body 12 and the second exposed portion 24*b* exposed on the second end surface 12*f*. The protective layer 50 is made of, for example, a resin material having high electric insulation such as acrylic resin, epoxy resin, and polyimide. Although the protective layer 50 is provided, the present disclosure is not limited thereto, and may not necessarily be provided.

When a dimension of the coil component 10 in the length direction z is an L dimension, the L dimension is preferably 1.0 mm or more and 12.0 mm or less (i.e., from 1.0 mm to 12.0 mm). When a dimension of the coil component 10 in the width direction y is a W dimension, the W dimension is preferably 0.5 mm or more and 12.0 mm or less (i.e., from 0.5 mm to 12.0 mm). When a dimension of the coil component 10 in the pressing direction x is a T dimension, the T dimension is preferably 0.5 mm or more and 6.0 mm or less (i.e., from 0.5 mm to 6.0 mm).

2. Method for Manufacturing Coil Component

Next, a method for manufacturing the coil component will be described.

(A) Preparation of Metal Magnetic Particles

First, the metal magnetic particles are prepared. Here, the metal magnetic particles are not particularly limited, but, for example, Fe-based soft magnetic powders such as α-Fe, Fe—Si, Fe—Si—Cr, Fe—Si—Al, Fe—Ni, and Fe—Co may be used. A non-crystalline material having good soft magnetic properties is preferably used as the material form of the metal magnetic particles, but the present disclosure is not particularly limited, and may be a crystalline material.

The average particle diameter of the metal magnetic particles is not particularly limited, but two or more kinds of metal magnetic particles having different average particle diameters are preferably used. That is, the metal magnetic particles are dispersed in the resin material. Accordingly, from the viewpoint of improving filling efficiency of the metal magnetic particles, for example, the metal magnetic particles having different average particle diameters such as the first metal magnetic particles having an average particle diameter of 10 μm or more and 40 μm or less (i.e., from 10 μm to 40 μm) and the second metal magnetic particles having an average particle diameter of 1 μm or more and 20 μm or less (i.e., from 1 μm to 20 μm) are preferably used.

(B) Formation of Insulating Film

Next, the surface of the metal magnetic particles is coated with the insulating film. Here, when the insulating film is formed by a mechanical method, the surface of a magnetic powder can be coated with the insulating film by inputting the metal magnetic particles and the insulating material powder into a rotating container and compounding the particles by mechanochemical treatment.

(C) Production of Magnetic Sheet

Next, the resin material is prepared. The resin material is not particularly limited, and for example, epoxy resin, phenol resin, polyester resin, polyimide resin, and polyolefin resin can be used.

Subsequently, a magnetic sheet having a thickness of 50 μm or more and 300 μm or less (i.e., from 50 μm to 300 μm)

is produced by mixing the metal magnetic particles coated with the insulating film and other filler components (glass material, ceramic powder, and ferrite powder) with the resin material, forming the mixture into a slurry, performing molding by using a doctor blade method, drying the molded filler, and dispersing the filler components into the resin material.

(D) Production of Collective Substrate

Next, the α-wounded coil conductor 16 formed by winding the rectangular conductive wire coated with the insulating film 18 is prepared by using Cu as the conductive wire. If necessary, the insulating film 18 in a region of 50 μm from an end of the coil conductor 16 is removed with a nipper-shaped clip. Accordingly, the insulating film removed portion 30 that is a portion not covered with the insulating film 18 is formed in an annular shape with an extending direction of the coil conductor 16 as a central axis. The insulating film 18 can be removed by being burned off by heating, or may be dissolved by a chemical solution or a laser. At this time, the recesses 28 may be provided in advance in the first extended portion 22*a* and the second extended portion 22*b* of the coil conductor 16.

Subsequently, the element body 12 in which the coil conductor 16 is buried is manufactured.

FIGS. 12A to 12D illustrate a manufacturing process diagram illustrating an embodiment of manufacturing a first molded body in the method for manufacturing the coil component. FIGS. 13A to 13D illustrate a manufacturing process diagram illustrating an embodiment of manufacturing a collective substrate in the method for manufacturing the coil component.

Figure 12A:
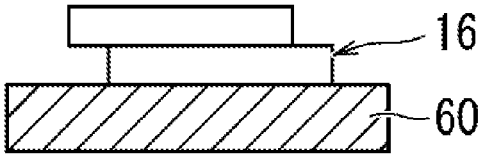
FIGS. 12A to 12D illustrate a manufacturing process diagram illustrating an embodiment in which a first molded body is manufactured in a method for manufacturing a coil component.

First, as illustrated in FIG. 12A, a first mold 60 is prepared, and the coil conductors 16 are arranged in a matrix on the first mold 60.

Figure 12B:
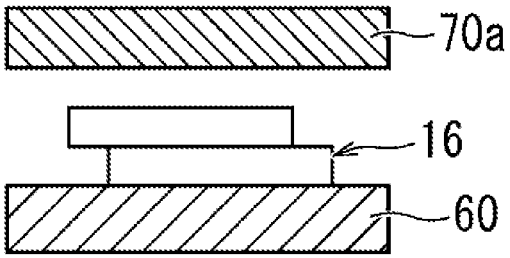
Figure 12C:
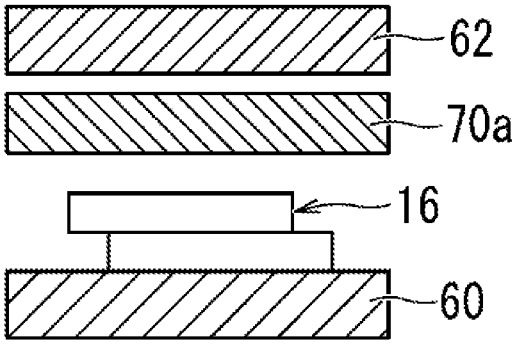
Figure 12D:
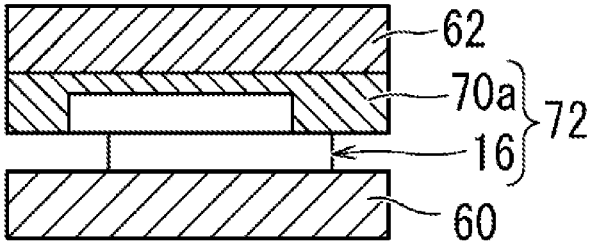

Next, a first magnetic sheet 70*a* of the mixture containing the first metal magnetic particles, the second metal magnetic particles, and the resin material is layered on the coil conductors 16 as illustrated in FIG. 12B, and a second mold 62 is arranged on an upper surface side of the first magnetic sheet 70*a* as illustrated in FIG. 12C. As illustrated in FIG. 12D, primary press molding is performed on the first magnetic sheet 70*a* while sandwiching the first magnetic sheet 70*a* between the coil conductors 16 on the first mold 60, and the second mold 62. Due to this primary press molding, a first molded body 72 is produced by burying at least a part of the coil conductors 16 in the sheet and filling the coil conductors 16 with the mixture.

Figure 13A:
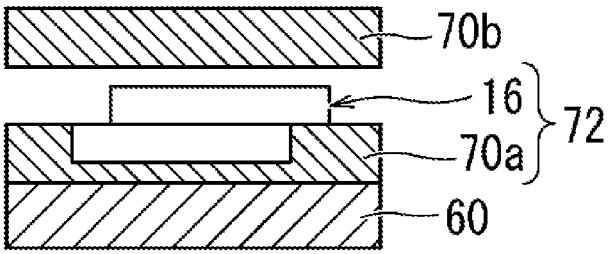
FIGS. 13A to 13D illustrate a manufacturing process diagram illustrating an embodiment of manufacturing a collective substrate in the method for manufacturing the coil component.
Figure 13B:
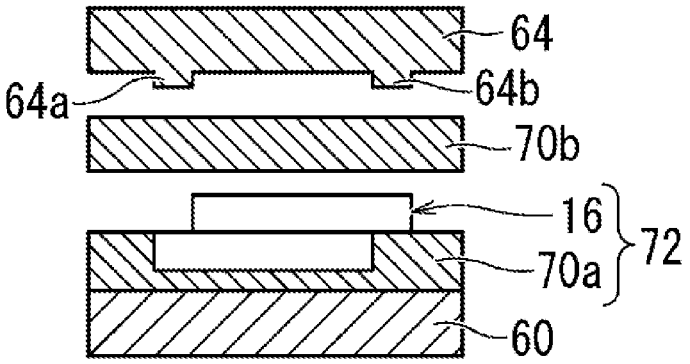
Figure 13C:
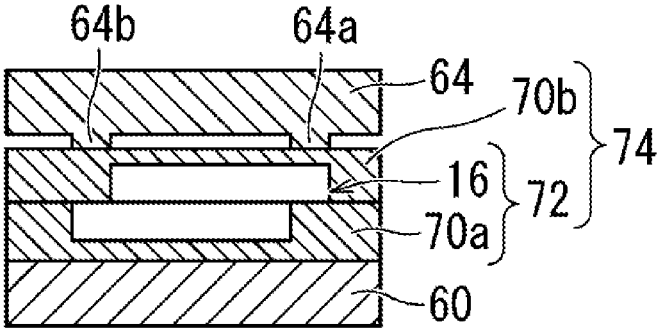

Subsequently, as illustrated in FIG. 13A, the first molded body 72 is arranged on the first mold 60 by separating the first molded body 72 in which the coil conductors 16 obtained by the primary press molding is buried from the second mold 62 and turning over the first molded body 72. Another second magnetic sheet 70*b* is layered on the surface on which the coil conductors 16 are exposed. Subsequently, as illustrated in FIG. 13B, a third mold 64 is arranged on an upper surface side of the second magnetic sheet 70*b*. As illustrated in FIG. 13C, secondary pressing is performed on the second magnetic sheet 70*b* while sandwiching the second magnetic sheet 70*b* between the first molded body 72 on the first mold 60 and the third mold 64.

Protrusions 64*a* and 64*b* are arranged on the third mold 64 at portions corresponding to the extended portions. In the secondary pressing, the protrusions 64*a* and 64*b* can apply a pressure to the peripheries of the extended portions with the second magnetic sheet interposed therebetween. Accordingly, in the secondary pressing illustrated in FIG. 13C, the metal magnetic particles 14*a* and the insulating film 18 are buried in the surfaces of the first extended portion 22*a* and the second extended portion 22*b* of the coil conductor 16.

In the secondary pressing, the metal magnetic particles can be arranged so as to be buried by adjusting the pressure during pressurization or providing the recesses on the surfaces of the extended portions in advance.

Figure 13D:
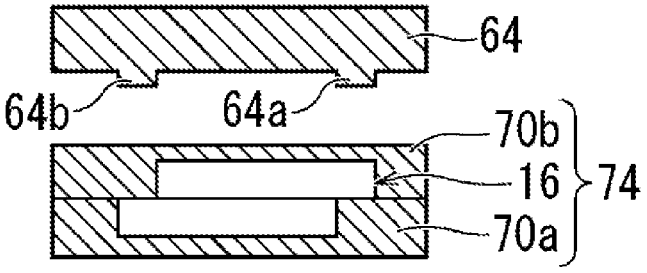

Subsequently, after the secondary pressing, the collective substrate (second molded body) 74 in which all the coil conductors 16 are buried in the first magnetic sheet 70*a* and the second magnetic sheet 70*b* by separating the third mold 64 is produced as illustrated in FIG. 13D.

(E) Production of Element Body

Subsequently, after the collective substrate 74 is produced by separating the first mold 60 and the third mold 64 as illustrated in FIG. 13D, the collective substrate 74 is cut along a cutting line by using a cutting tool such as a dicer, and is divided into individual elements. Accordingly, the element body 12 in which the coil conductors 16 are buried such that the first exposed portion 24*a* and the second exposed portion 24*b* of the coil conductor 16 are exposed from both the end surfaces of the element body 12 is produced. The division of the collective substrate 74 into the element bodies 12 can be performed by using a dicing blade, various laser devices, dicers, various blades, and molds. In a preferred aspect, a cut surface of each element body 12 is barrel polished.

Subsequently, the protective layer 50 is formed on the entire surface of the element body obtained above. The protective layer 50 can be formed by electrodeposition coating, a spray method, or a dip method.

The insulating films 18 on the peripheries of the coil conductor 16 at which the first exposed portion 24*a* and the second exposed portion 24*b* are arranged, the metal magnetic particles 14*a*, the insulating film coated on the metal magnetic particles 14*a*, and the protective layer 50 are removed and the metal magnetic particles 14*a* are melted by irradiating the periphery of the element body 12 coated with the protective layer 50 obtained above at which the first exposed portion 24*a* and the second exposed portion 24*b* of the coil conductor 16 are arranged with laser. The protective layer 50 can be removed by blasting or polishing other than the laser irradiation.

(F) Formation of External Electrode

Subsequently, the first external electrode 40*a* is formed on the first end surface 12*e* of the element body 12, and the second external electrode 40*b* is formed on the second end surface 12*f* of the element body 12.

First, the base electrode layer is formed by performing Cu plating on the element body 12 by electrolytic barrel plating. Subsequently, the external electrode 40 is formed by forming the Ni plated layer on the surface of the base electrode layer by Ni plating and further forming the Sn plated layer by Sn plating. Accordingly, the first exposed portion 24*a* of the coil conductor 16 is electrically connected to the first external electrode 40*a*, and the second exposed portion 24*b* of the coil conductor 16 is electrically connected to the second external electrode 40*b*.

The coil component 10 is manufactured as described above.

The metal magnetic particles 14*a* of the magnetic portion 14 may be arranged in the recesses formed in the surface of the conductive wire 16*a* of the coil conductor 16 at the winding portion 20 inside the element body 12.

The metal magnetic particles 14*a* of the magnetic portion 14 are arranged in the recesses 28 formed on the surface of the first exposed portion 24*a* and the surface of the second exposed portion 24*b* of the coil conductor 16 from which the insulating film 18 is removed, and thus, an anchor effect due to the metal magnetic particles 14*a* occurs. Accordingly, the bonding strength between the magnetic portion 14 and the coil conductor 16 can be improved.

Since the coil conductor 16 and the external electrode 40 are directly bonded, the contact resistance can be reduced.

As described above, although the embodiment of the present disclosure is disclosed in the above description, the present disclosure is not limited thereto.

That is, various changes of the mechanism, shape, material, quantity, position, and arrangement can be implemented on the embodiment described above without departing from the technical idea and scope of the present disclosure, and are included in the present disclosure.

What is claimed is:

1. A coil component comprising:

an element body that includes:

a coil conductor configured by winding a conductive wire coated with an insulating film, and a magnetic portion that contains metal magnetic particles and resin; and external electrodes that are electrically connected to exposed surfaces of extended portions of the coil conductor, the exposed surfaces being exposed on a surface of the element body, and the external electrodes being provided on the surface of the element body, wherein the metal magnetic particles are arranged in recesses in a surface of the conductive wire in the extended portions of the coil conductor.

2. The coil component according to claim 1, wherein insulating film removed portions, that are absent the insulating film, are provided at the extended portions of the coil conductor, and the recesses are in the insulating film removed portions, and the metal magnetic particles are arranged thereon.

3. The coil component according to claim 2, wherein the insulating film removed portions and the external electrodes are directly connected.

4. The coil component according to claim 1, wherein the metal magnetic particles are coated with an insulating film.

5. The coil component according to claim 4, wherein in the metal magnetic particles in contact with the external electrodes, an average thickness of the insulating films of the metal magnetic particles that are in contact with the external electrodes is thinner than an average thickness of the insulating films of the metal magnetic particles that are not in contact with the external electrodes.

6. The coil component according to claim 1, wherein irregularities are on a surface of the exposed surfaces of extended portions of the coil conductor.

7. The coil component according to claim 1, wherein indented portions are in the element body on peripheries of the exposed surfaces of extended portions of the coil conductor, such that an average distance between the coil conductor and the magnetic portion is increased in a direction in which the coil conductor is extended to the surface of the element body.

8. The coil component according to claim 1, wherein a groove having a depth of from 5 μm to 100 μm is in the exposed surface of extended portions of the coil conductor.

9. The coil component according to claim 1, wherein the external electrodes are plating electrodes.

10. The coil component according to claim 2, wherein the metal magnetic particles are coated with an insulating film.

11. The coil component according to claim 3, wherein the metal magnetic particles are coated with an insulating film.

12. The coil component according to claim 2, wherein irregularities are on a surface of the exposed surfaces of extended portions of the coil conductor.

13. The coil component according to claim 3, wherein irregularities are on a surface of the exposed surfaces of extended portions of the coil conductor.

14. The coil component according to claim 4, wherein irregularities are on a surface of the exposed surfaces of extended portions of the coil conductor.

15. The coil component according to claim 5, wherein irregularities are on a surface of the exposed surfaces of extended portions of the coil conductor.

16. The coil component according to claim 2, wherein indented portions are in the element body on peripheries of the exposed surfaces of extended portions of the coil conductor, such that an average distance between the coil conductor and the magnetic portion is increased in a direction in which the coil conductor is extended to the surface of the element body.

17. The coil component according to claim 3, wherein indented portions are in the element body on peripheries of the exposed surfaces of extended portions of the coil conductor, such that an average distance between the coil conductor and the magnetic portion is increased in a direction in which the coil conductor is extended to the surface of the element body.

18. The coil component according to claim 2, wherein a groove having a depth of from 5 μm to 100 μm is in the exposed surface of extended portions of the coil conductor.

19. The coil component according to claim 3, wherein a groove having a depth of from 5 μm to 100 μm is in the exposed surface of extended portions of the coil conductor.

20. The coil component according to claim 2, wherein the external electrodes are plating electrodes.

* * * * *